US006493535B2

(12) United States Patent
Okubo

(10) Patent No.: US 6,493,535 B2
(45) Date of Patent: Dec. 10, 2002

(54) CLEANING APPARATUS AND IMAGE FORMING APPARATUS

(75) Inventor: Hisakazu Okubo, Moriya-machi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/779,523

(22) Filed: Feb. 9, 2001

(65) Prior Publication Data

US 2001/0026718 A1 Oct. 4, 2001

(30) Foreign Application Priority Data

Feb. 15, 2000 (JP) ..... 2000-036226
Feb. 6, 2001 (JP) ..... 2001-028945

(51) Int. Cl.[7] ..... G03G 21/00
(52) U.S. Cl. ..... 399/353; 399/358; 15/256.5
(58) Field of Search ..... 15/256.5, 256.52, 15/256.53; 399/102, 345, 353, 354, 355, 358, 359, 360

(56) References Cited

U.S. PATENT DOCUMENTS 5,669,041 A * 9/1997 Thayer et al. ..... 399/102

* cited by examiner

*Primary Examiner*—Hoang Ngo
(74) *Attorney, Agent, or Firm*—Fitzpatrick, Cella, Harper & Scinto

(57) ABSTRACT

A cleaning apparatus that cleans an image bearing member on which a toner image is formed, includes first and second brushes which are rotatable and remove toner by abutment against the image bearing member, wherein the first and second brushes rotate in counter directions, a container for containing the toner removed by the first brush and the second brush, and a rubbing member that rubs both of the first brush and the second brush.

38 Claims, 9 Drawing Sheets

CLEANING APPARATUS AND IMAGE FORMING APPARATUS

BACKGROUND OF THE INVENTION

1. Field of the Invention

The present invention relates to a cleaning apparatus for conducting cleaning by using a brush, and an image forming apparatus having the cleaning apparatus, such as a copying machine, a printer and a facsimile machine.

2. Related Background Art

Among image forming apparatuses such as a copying machine, in particular, a full-color image forming apparatus employs a recording material bearing member formed of a dielectric film or the like for bearing and conveying a recording material. In the image forming apparatus of this type, in the case where a surface of the recording material bearing member is stained by splashed toner or the like within an apparatus, in order to prevent a back surface of the recording material from being stained, a cleaning device for a recording material bearing member is frequently employed.

Incidentally, as the above-described cleaning apparatus, there has been known a fur brush cleaner essentially consisting of one fur brush 51 and a housing 53 as shown in FIG. 8. In order to effectively collect toner removed by the fur brush 51, the cleaner is equipped with a scraper 54 as a flicking member substantially opposite to a side of the fur brush 51 which is in contact with a recording material bearing member 5*f*. The toner removed from the recording material bearing member 5*f* is carried to the opposite side in accordance with the rotation of the fur brush 51, the fur brush 51 is patted by the scraper 54, and the toner is removed from the fur brush 51.

Also, as shown in FIG. 9, there has been known a fur brush cleaner having two fur brushes 51*a* and 51*b* that rotate in counter directions, respectively, and scrapers 54*a* and 54*b* as a flicking member at the respective fur brushes 51*a* and 51*b*.

However, in the conventional fur brush cleaner shown in FIG. 8, because the toner removed by the fur brush 51 is splashed in a tangent direction (a direction indicated by an arrow in FIG. 8) of a portion which is in contact with the recording material bearing member 5*f* by a centrifugal force caused by the rotation of the fur brush 51 before the toner is carried to the scraper 54, most of the toner is collected on a portion A in FIG. 8 and caused to be fixed onto a wall of the housing 53. In particular, if the peripheral speed of the fur brush 51 is increased in order to improve the cleaning capability of the fur brush cleaner, the above phenomenon becomes remarkable, thereby resulting in a case where even if the volume of the housing 53 for containing the toner is enlarged, the cleaner does not effectively function, and the cleaner must be cleaned at an early stage to remove the toner that dropped down from the portion A.

Also, in the conventional fur brush shown in FIG. 9, if the rotating directions of the respective fur brushes 51*a* and 51*b* are set as shown in FIG. 9, the possibility that the above-mentioned problem occurs becomes low because counter fur brushes 51*b* and 51*a* are situated in the tangent direction of contact portions of the respective fur brushes 51*a* and 51*b* with the recording material bearing member 5*f*. However, after the removed toner has been carried to the respective scrapers 54*a* and 54*b*, when the fur brushes 51*a* and 51*b* are patted by the scrapers 54*a* and 54*b*, the toner is splashed in the tangent directions (directions indicated by arrows in FIG. 9) of portions of the fur brushes 51*a* and 51*b* which are in contact with the scrapers 54*a* and 54*b*. Therefore, most of the toner is collected on portions B in FIG. 9 and is caused to be fixed, and the same problem as that with the fur brush cleaner shown in FIG. 8 occurs.

SUMMARY OF THE INVENTION

The present invention has been made under the above circumstances, and therefore one object of the present invention is to provide a cleaning apparatus which is capable of appropriating a direction along which the toner removed by a first brush and a second brush from an image bearing member is splashed.

Another object of the present invention is to provide a cleaning apparatus which is capable of appropriating a direction along which the toner removed by a first brush and a second brush from a recording material bearing member is splashed.

Still another object of the present invention is to provide an image forming apparatus which is capable of appropriating a direction along which the toner removed by a first brush and a second brush from an image bearing member is splashed.

Yet still another object of the present invention is to provide an image forming apparatus which is capable of appropriating a direction along which the toner removed by a first brush and a second brush from a recording material bearing member is splashed.

Other objects of the present invention will become apparent by reading the following detailed explanation.

BRIEF DESCRIPTION OF THE DRAWINGS

These and other objects and advantages of this invention will become more fully apparent from the following detailed description taken with the accompanying drawings in which.

DESCRIPTION OF THE PREFERRED EMBODIMENTS

Now, a description will be given in more detail of preferred embodiments of the present invention with reference to the accompanying drawings.

(First Embodiment)

Figure 1:
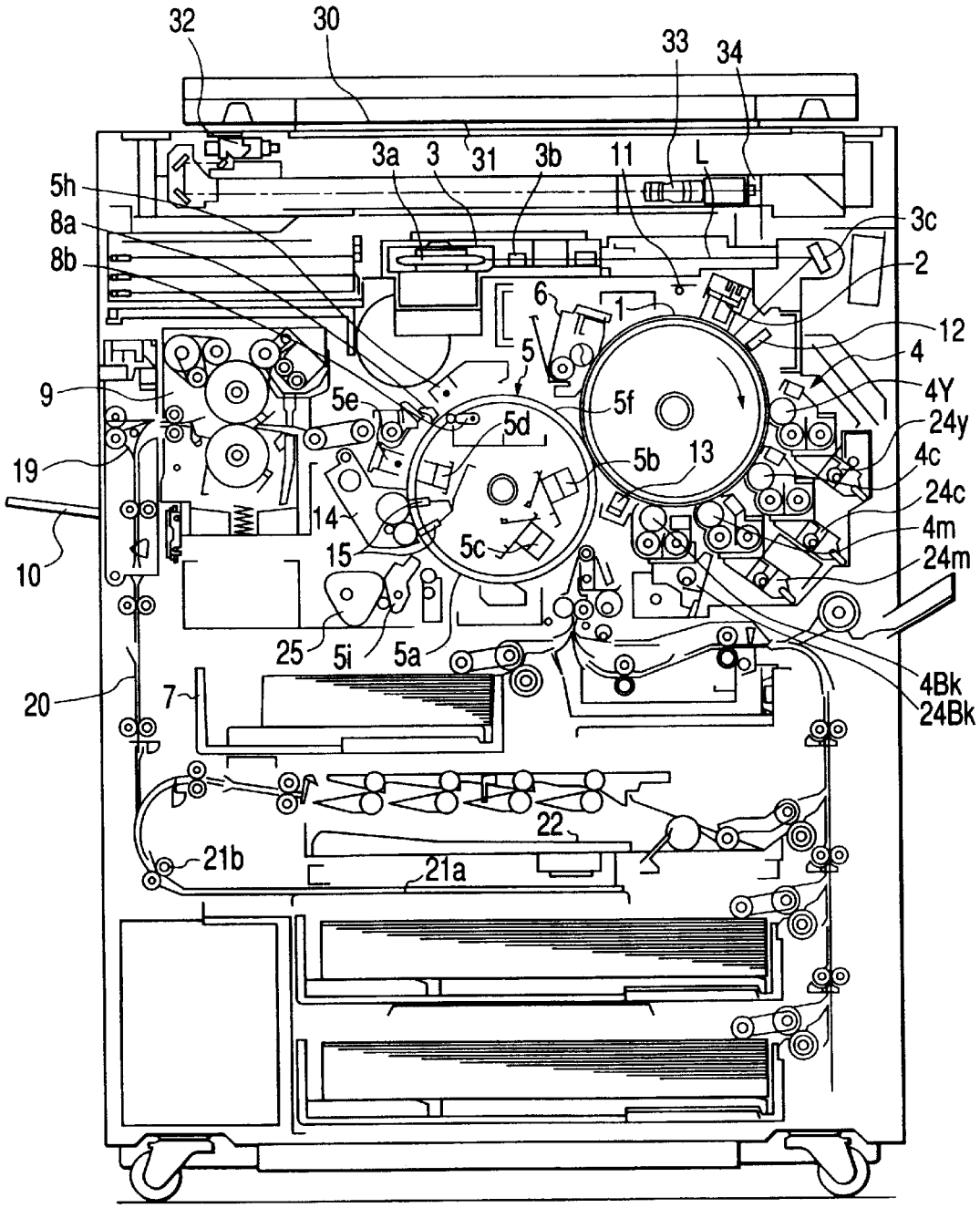
FIG. 1 is a cross-sectional view showing the outline of a full-color image forming apparatus having a fur brush cleaner in accordance with the present invention.

FIG. 1 is a cross-sectional view showing the outline of a full-color image forming apparatus having a fur brush cleaner in accordance with the present invention. A digital color image reader section is disposed in an upper portion of the full color image forming apparatus and a digital color image printer section is disposed in a lower portion of the full color image forming apparatus.

In the digital color image reader section, an original 30 is rested on an original glass stand 31 and then subjected to exposure scanning by an exposure lamp 32, whereby a reflected optical image from the original 30 is condensed onto a full color CCD sensor 34 by a lens 33 to obtain a color separation image signal. The color separation image signal passes through an amplifier circuit (not shown), processed by a video processing unit not shown and sent out to the digital color image printer section.

In the digital color image printer section, a photosensitive drum 1 serving as an image bearing member is supported to be rotated in a direction indicated by an arrow, and in the periphery of the photosensitive drum 1 are disposed a pre-exposure lamp 11, a corona charger 2, a laser exposure optical system 3, an electrostatic voltmeter 12, four developing devices 4*y*, 4*c*, 4*m* and 4Bk each different in color, an on-drum light amount detecting means 13, a transfer device 5 serving as a recording material bearing member and a cleaning device 6.

In the laser exposure optical system 3, an image signal from the reader section is converted into an optical signal by a laser output section, a laser beam converted into the optical signal is reflected by a polygon mirror 3*a*, passes through a lens 3*b* and a mirror 3*c* and is then projected onto a surface of the photosensitive drum 1.

In the printer section, at the time of forming an image, the photosensitive drum 1 is driven to be rotated in a direction indicated by an arrow in FIG. 1, the photosensitive drum 1 which has been subjected to charge elimination by the pre-exposure lamp 11 is uniformly charged by a corona charger 2, and optical images L are irradiated onto the photosensitive drum 1 for the respective separation colors, to thereby form latent images on the photosensitive drum 1.

Then, the developing devices (4*y*, 4*c*, 4*m*, 4Bk) are operated to develop the latent images on the photosensitive drum 1 by using toners basically containing resin and pigment, and toner images are formed on the photosensitive drum 1. The respective developing devices 4*y*, 4*c*, 4*m* and 4Bk are so structured as to alternatively approach the photosensitive drum 1 in accordance with the respective separation colors by the operation of eccentric cams 24*y*, 24*c*, 24*m* and 24Bk.

In this way, the toner images on the photosensitive drum 1 are transferred onto a recording material which is supplied from a recording material cassette 7 through a conveying system and the transfer device 5 to a position in which the recording material is opposite to the photosensitive drum 1. The transfer device 5 includes a transfer drum 5*a*, a transfer charger 5*b*, an attracting charger 5*c* for electrostatically attracting the recording material, an attracting roller 5*g* opposite to the attracting charger 5*c*, an inner charger 5*d* and an outer charger 5*e*. A recording material bearing sheet 5*f* made of dielectric integrally extends in a cylindrical shape on the peripheral opening area of the transfer drum 5*a* which is axially supported so as to be rotatably driven. In this embodiment, the recording material bearing sheet 5*f* serving as a member to be cleaned is formed by a dielectric sheet such as a polycarbonate film.

In this way, the toner image on the photosensitive drum 1 is transferred onto the recording material borne on the recording material bearing sheet 5*f* by the transfer charger 5*b* as the transfer drum 5*a* rotates. Thus, a desired number of color images are transferred onto the recording material electrostatically attracted and conveyed by the recording material bearing sheet 5*f*, to thereby form a full color image on the recording material.

In the case of forming the full color image, upon completion of the transfer of the four-color toner images as described above, the recording material is separated from the transfer drum 5*a* by the actions of a separation claw 8*a*, a separation push-up roller 8*b* and a separation charger 5*h*, and after the toner image has been fixed onto the separated recording material by a thermal roller fixing device 9, the recording material is discharged to a discharge tray 10. After the toner image has been transferred onto the recording material, the photosensitive drum 1 is cleaned by removing residual toner on the surface of the photosensitive drum 1 by the cleaning device 6, and the above image forming process is again conducted in the image forming process.

Also, in the case of forming images on both surfaces of the recording material, a conveying path change-over guide 19 is driven immediately after the recording material has passed through the thermal roller fixing device 9, the recording material passes through a vertical conveying path 20 and is guided to a surface reverse path once. Thereafter, the recording material is fed backward in a counter direction to the forward direction by the reverse rotation of a surface reverse roller 21*b* with a trailing end of the recording material which has been fed forward as a leading end, and is then contained in an intermediate tray 22. Thereafter, the image forming process as described above is again conducted to form an image on the other surface of the recording material.

In this way, in order to remove the strain such as splashed toner stuck on the recording material bearing sheet 5*f* of the transfer drum 5*a*, cleaning is conducted by the section of a fur brush cleaner 14 and a backup brush 15 as a counter member that is opposite to the fur brush cleaner 14 through the recording material bearing sheet 5*f*. The fur brush cleaner 14 is spaced from the transfer drum at least while the recording material passes through a cleaning position, and the fur brush cleaner 14 is abutted against the transfer drum at a desired timing to conduct a cleaning operation. Specifically, the above-described cleaning operation is conducted at any time before an image formation, after the image formation, and during a restoring sequence after the occurrence of recording material jamming.

Also, in this embodiment, the eccentric cam 25 is actuated at a desired timing and a cam follower 5*i* integrated with the transfer drum 5*a* is actuated, to thereby set a gap between the recording material bearing sheet 5*f* and the photosensitive drum 1 arbitrarily. For example, during a standby state or a switched-off state of a power supply, a space between the transfer drum 5*a* and the photosensitive drum 1 is made long.

Subsequently, the detailed structure of the fur brush cleaner 14 will be described with reference to FIG. 2.

Figure 2:
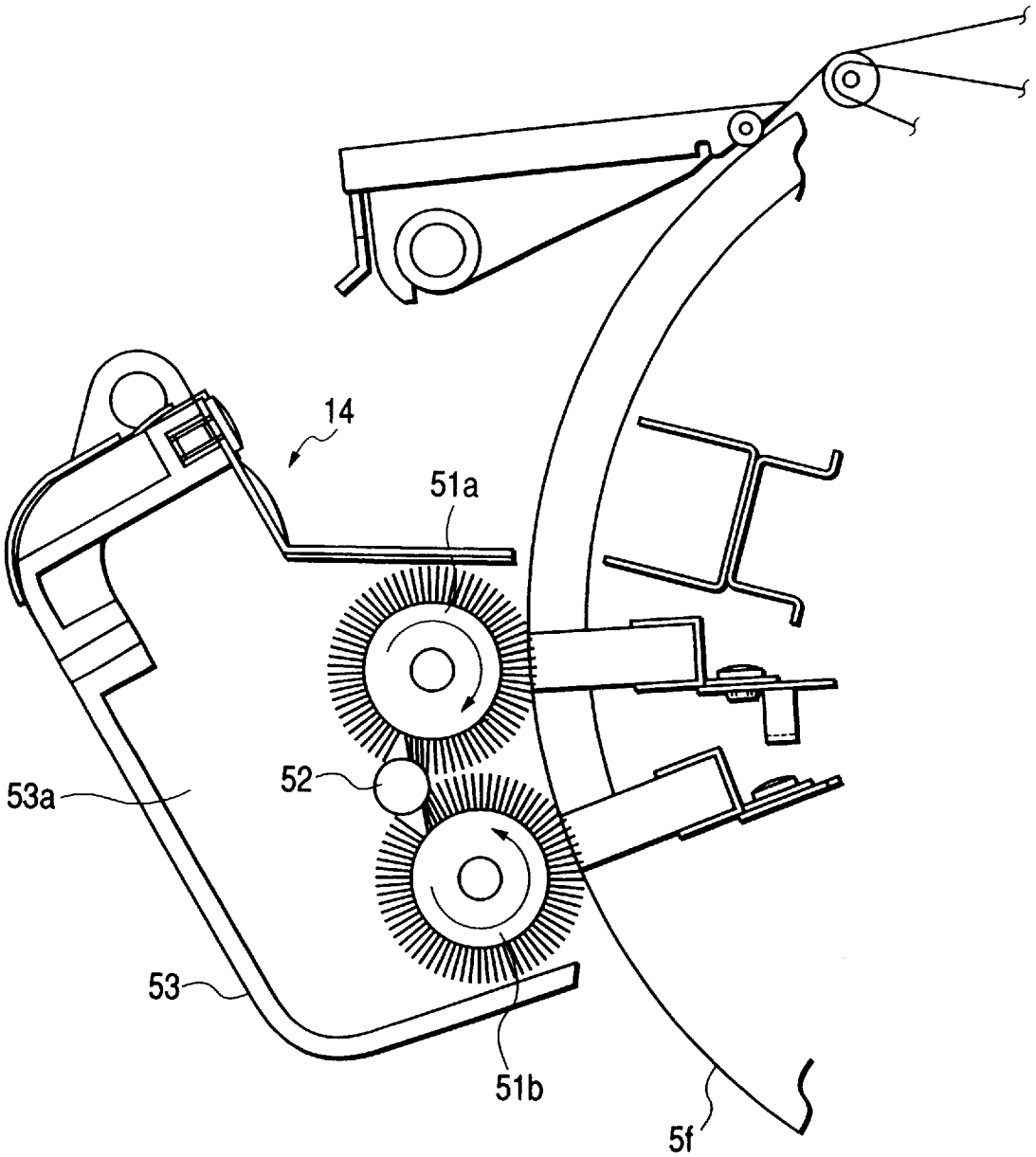
FIG. 2 is a cross-sectional view showing the structure of a fur brush cleaner in accordance with a first embodiment of the present invention.

FIG. 2 is a cross-sectional view showing the structure of the fur brush cleaner 14. In FIG. 2, reference characters 51*a* and 51*b* denote fur brushes disposed at a predetermined space therebetween. Those fur brushes 51*a* and 51*b* are rotatably held by a cleaner housing 53 serving as containing means and rotationally driven in directions indicated by arrows by motors, respectively. The rotational driving is made in such a manner that a peripheral speed of the fur brush 51*a* is higher than a peripheral speed of the transfer drum surface. The fur brush 51*b* is rotationally driven in a counter direction to the rotating direction of the fur brush 51*a* at the same peripheral speed as that of the fur brush 51*a*. The fur brushes 51*a* and 51*b* are formed by implanting fibers made of rayon or acrylic or the like on a core metal.

Reference numeral 52 denotes a flicker rod as a rubbing member (a flicking member), which is fixed to the cleaner housing 53. In addition, the flicker rod 52 is disposed between the fur brushes 51*a* and 51*b* so as to be abutted against both of the fur brushes 51*a* and 51*b* and rubbed thereon. An inroad amount of the flicking member with respect to the respective fur brushes may be set appropriately.

In this embodiment, the flicker rod 52 is formed of a cylindrical rode made of metal about ϕ6 mm in diameter, but if a sufficient strength of such a flicker rod is obtained by other materials, the flicker rod 52 may be made of another material such as resin. A toner containing portion 53*a* is formed inside of the cleaner housing 53, and an opening portion is disposed in the cleaner housing 53 at a side opposite to the transfer drum 5*a*.

Subsequently, the operation of the fur brush cleaner 14 having the above structure will be described with reference to FIG. 3.

Figure 3:
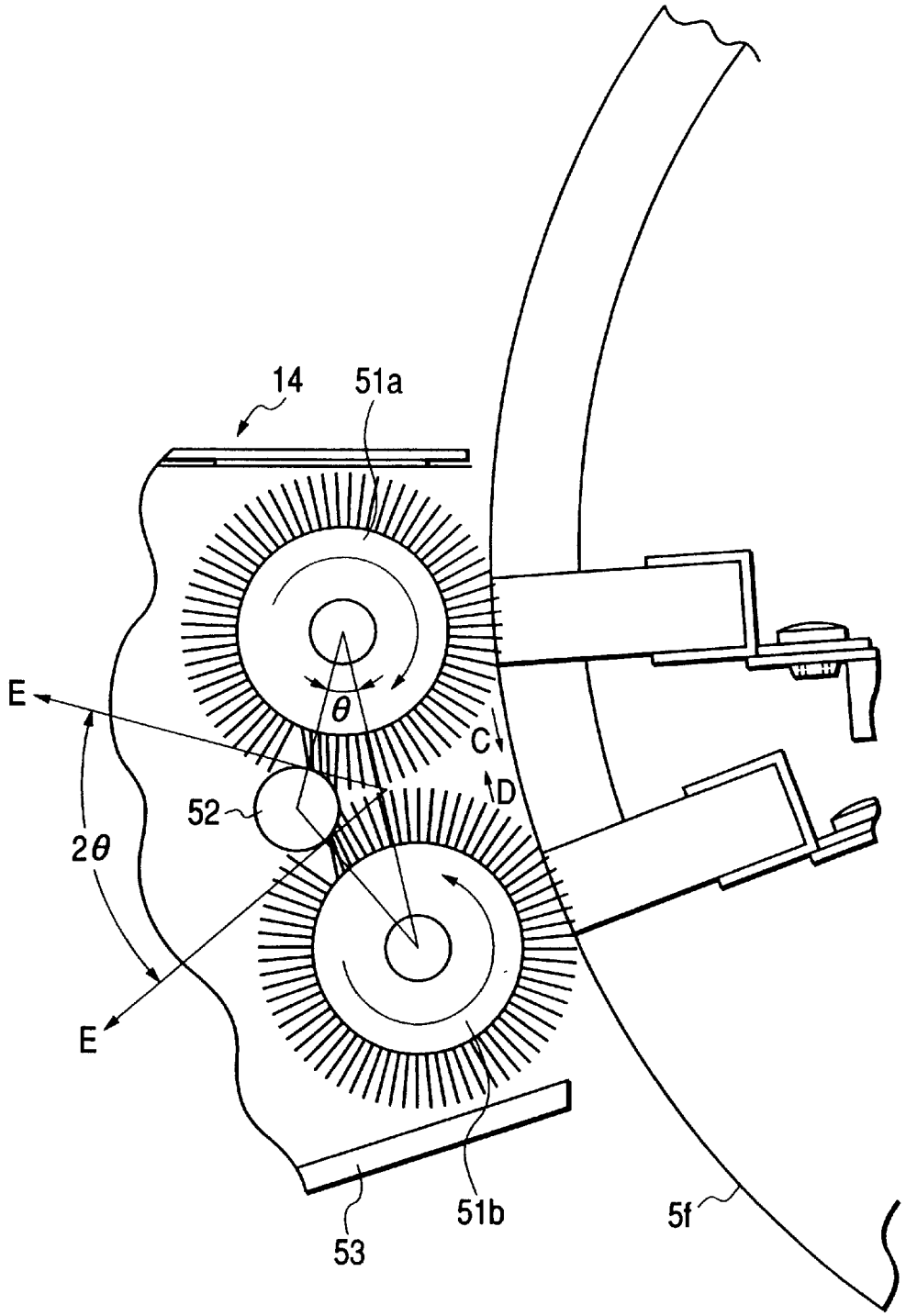
FIG. 3 is a partially enlarged cross-sectional view showing the structure of the fur brush cleaner in accordance with the first embodiment of the present invention.

FIG. 3 is a partially enlarged cross-sectional view showing the structure of the fur brush cleaner 14. As shown in FIG. 3, after the fur brushes 51*a* and 51*b* are rotationally driven by a motor (not shown), they are abutted against the recording material bearing sheet 5*f*, and unnecessary toner on the recording material bearing sheet 5*f* is scraped off and removed. In this operation, a part of the toner scraped by the fur brush 51*a* is splashed in a direction indicated by an arrow C, and a part of the toner scraped by the fur brush 51*b* is splashed in a direction indicated by an arrow D. The toner is stuck onto the counter fur brushes 51*b* and 51*a*, respectively, and again carried within the cleaner housing 53. Then, the toner carried within the cleaner housing 53 flies in a direction indicated by an arrow E (in a direction apart from the opening portion of the cleaner 14), that is, toward an opposite side of a side on which the transfer drum is disposed by a repulsive force of the hairs of the fur brushes 51*a* and 51*b* produced when the hairs patted by the flicker rod 52 are restored to original positions, and the toner is accumulated in the toner containing portion 53*a*.

In this example, because the arrows E are in the vicinity of the tangent directions of the fur brushes 51*a* and 51*b* at points where the flicker rod 52 is in contact with the fur brushes 51*a* and 51*b*, assuming that an angle defined by a straight line connecting two rotation center axes of the fur brushes 51*a* and 51*b* and a straight line connecting contact portions (in the case where the contact portions have widths, the center position of the contact area is set to "contact portion") of the rotation center axes of the respective fur brushes 51*a* and 51*b* with the flicker rod 52 is θ, an angle defined by the arrows E becomes about 2θ of the toner flipped by the flicker rod 52 becomes about 60°. The above angle θ may be set to 0° or more.

With the above structure, the toner can be prevented from dropping when the cleaner 14 is moved into contact with and separated from the cleaner housing 53 without sticking and depositing unnecessary toner to a wall around the opening portion of the cleaner housing 53, and the unnecessary toner can be effectively accumulated on the inmost side in the toner containing portion 53*a*.

The cleaner 14 is detachably attachable to a main body of an image forming apparatus. This structure enables the maintenance and usability of the apparatus to be improved.

(Second Embodiment)

Figure 4:
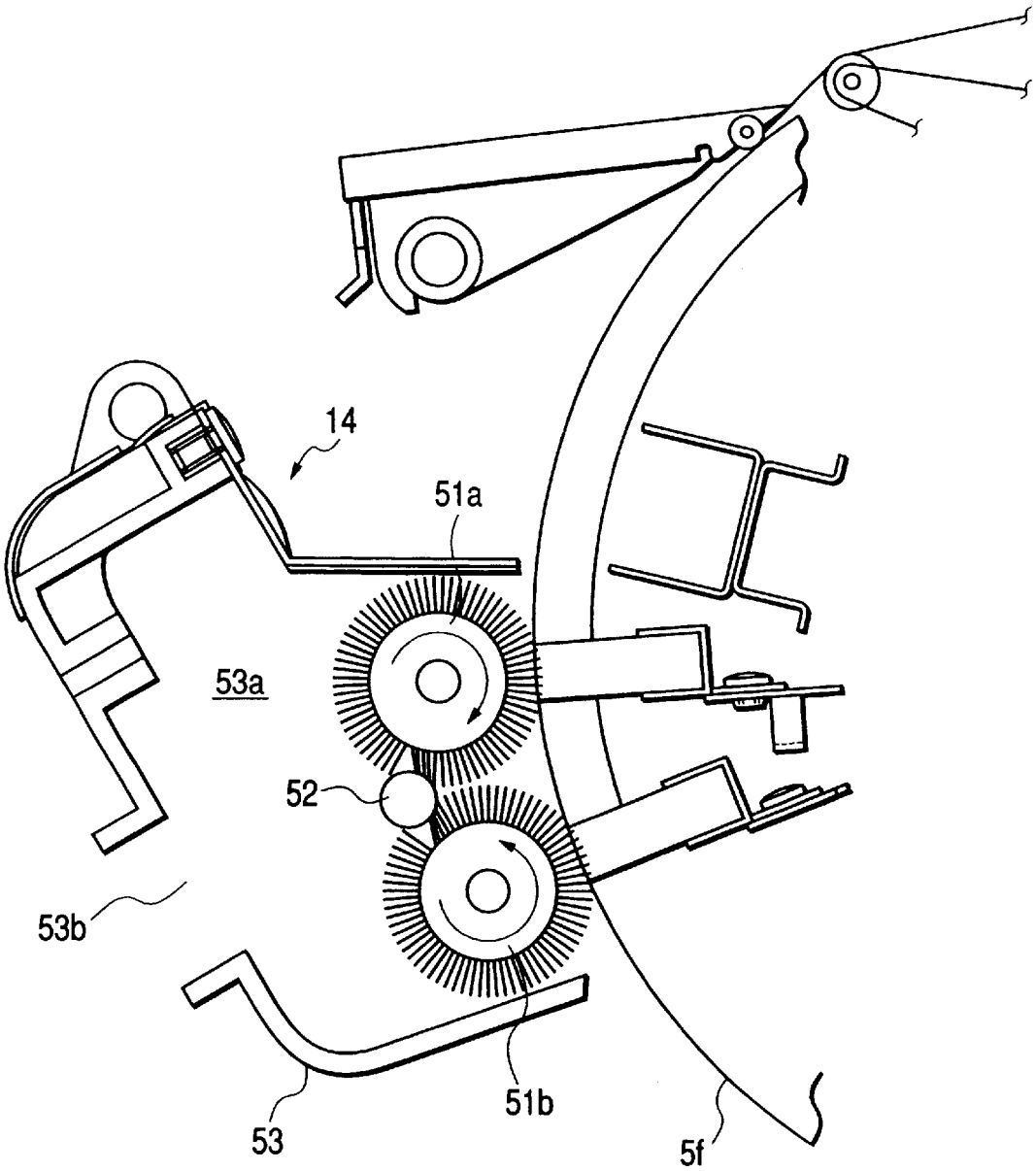
FIG. 4 is a cross-sectional view showing the structure of a fur brush cleaner in accordance with a second embodiment of the present invention.

Subsequently, a second embodiment of the present invention will be described with reference to FIG. 4. FIG. 4 is a cross-sectional view showing the structure of a fur brush cleaner in accordance with this embodiment. In FIG. 4, the same elements as those shown in FIG. 2 are designated by identical reference characters, and their description will be omitted.

A difference of this embodiment from the above first embodiment resides in that a suction port 53*b* is opened in the inmost portion of the toner housing 53. The suction pot 53*b* is connected to a duct and given a negative pressure to discharge the splashed toner.

With the application of the above structure, because the toner removed from the recording material bearing sheet 5*f* reaches the vicinity of the suction port 53*b* with the action of the flicker rod 52 and is then discharged, the unnecessary toner is effectively sucked and discharged without sticking and depositing the unnecessary toner on a wall of the toner housing 53.

(Third Embodiment)

Figure 5:
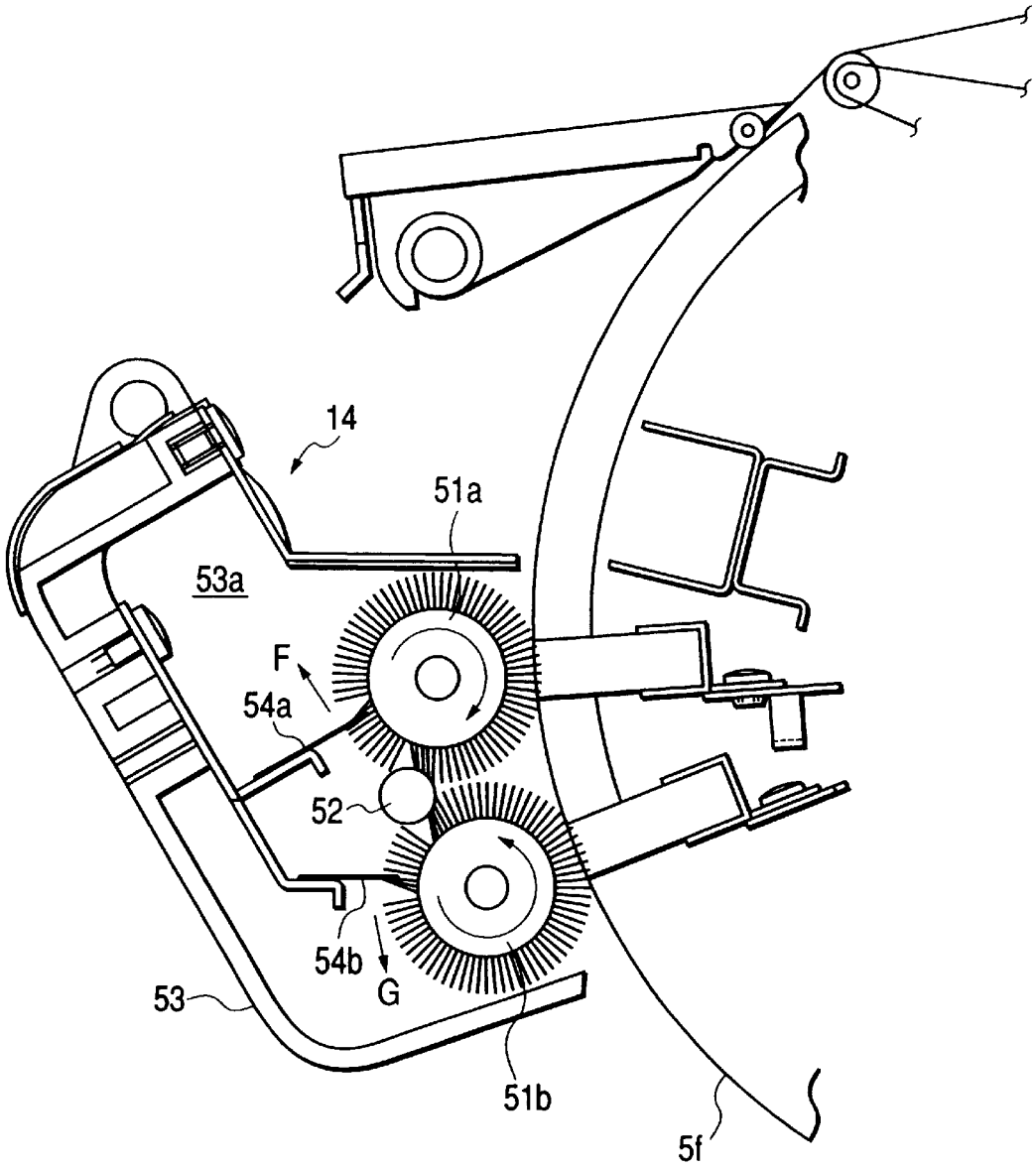
FIG. 5 is a cross-sectional view showing the structure of a fur brush cleaner in accordance with a third embodiment of the present invention.
Figure 6:
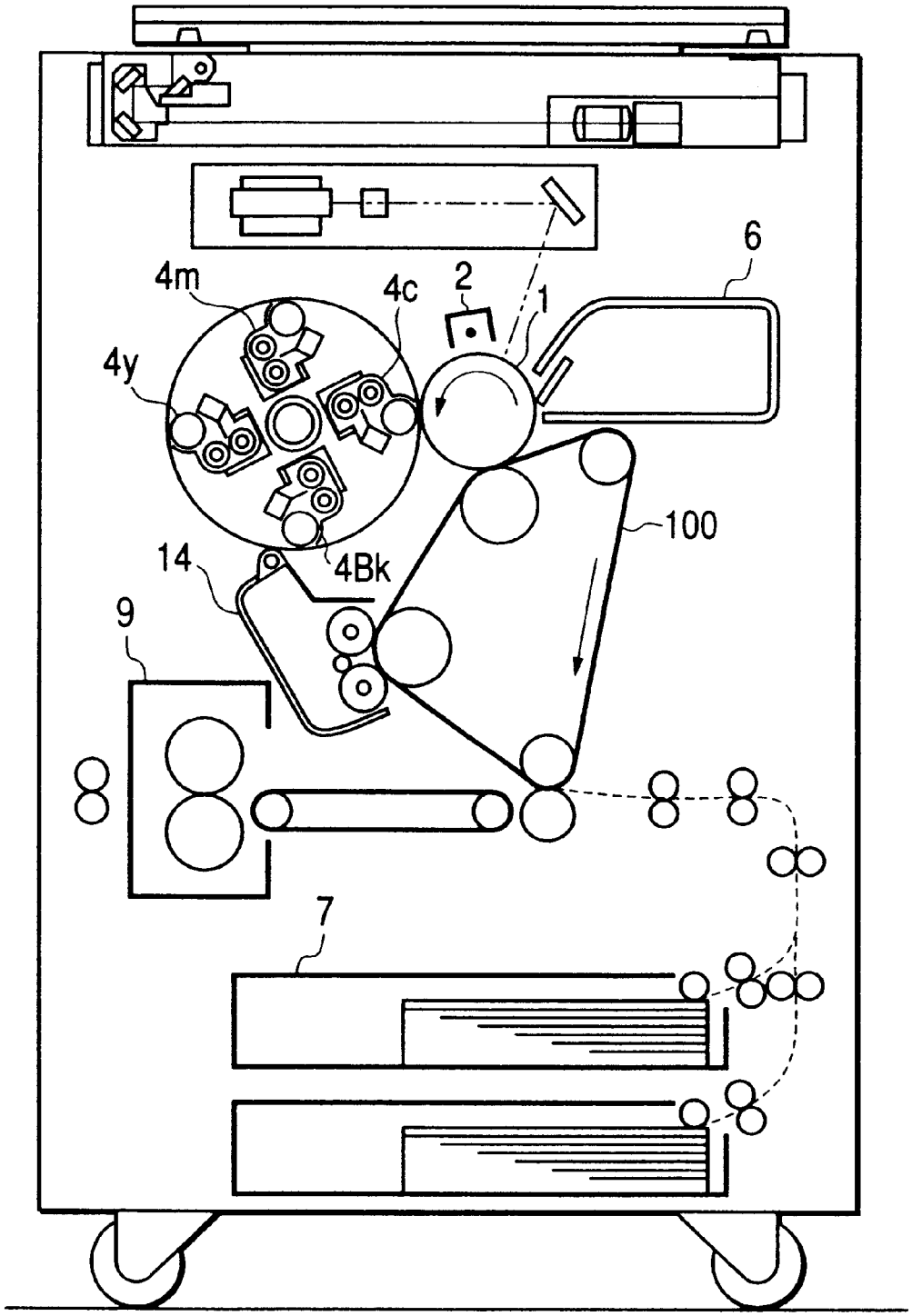
FIG. 6 is a diagram showing another applied example of the present invention.

Subsequently, a third embodiment of the present invention will be described with reference to FIG. 5. FIG. 5 is a cross-sectional view showing the structure of a fur brush cleaner in accordance with this embodiment. In FIG. 5, the same elements as those shown in FIG. 2 are designated by identical symbols, and their description will be omitted.

A difference of this embodiment from the above first embodiment resides in that scrapers 54*a* and 54*b* are disposed as a second flicking member, and the scrapers 54*a* and 54*b* are made of flexible material such as a polyester sheet. In this example, a reason why the scrapers 54*a* and 54*b* are used as the flicking members is that the flicking effect with respect to a rise of the rotation load of the fur brushes 51*a* and 51*b* is higher than the flicker effect with the flicker rod 52, and the scrapers 54*a* and 54*b* are more preferable as the second flicking member that reduces the limit of a space.

According to the above-described structure, the toner that cannot be removed in the flicker rod 52 is perfectly removed by the scrapers 54*a* and 54*b* so that the toner from the fur brushes 51*a* and 51*b* can be more surely collected. In this example, the toner removed by the respective scrapers 54*a* and 54*b* is splashed in directions indicated by arrows F and G, respectively. However, because most of the toner is removed by the flicker rod 52, the toner splash amount in the directions indicated by the arrows F and G are extremely slight without any problem.

In the above-mentioned respective embodiments 1 to 3, the examples in which the present invention is applied to the image forming apparatus having the recording material bearing member are described, but the present invention is not limited to or by the above examples.

For example, the present invention can be applied to an image forming apparatus having an intermediate transfer member 100 serving as an image bearing member. The image forming process will be described in brief. A process of primarily transferring the toner image formed on the photosensitive drum to an intermediate transfer member is repeated a desired number of times, and thereafter the toner image on the intermediate transfer member is secondarily transferred to the recording material, to thereby form a desired image on the recording material. Thereafter, the toner image is fixed onto the recording material by the fixing device and the recording material is then discharged to the external of the apparatus, thus completing a sequential image forming process.

Then, after the completion of the secondary transfer process, the intermediate transfer member is cleaned by using the cleaner 14 described in the above-mentioned first to third embodiments, thereby being capable of obtaining the same effect as that in the above-described first to third embodiments.

Since the structures except for the image forming process and the intermediate transfer member cleaned by the cleaner 14 are substantially identical with those in the above-described first to third embodiments, the respective members are designated by identical reference characters, and their description will be omitted.

Figure 7:
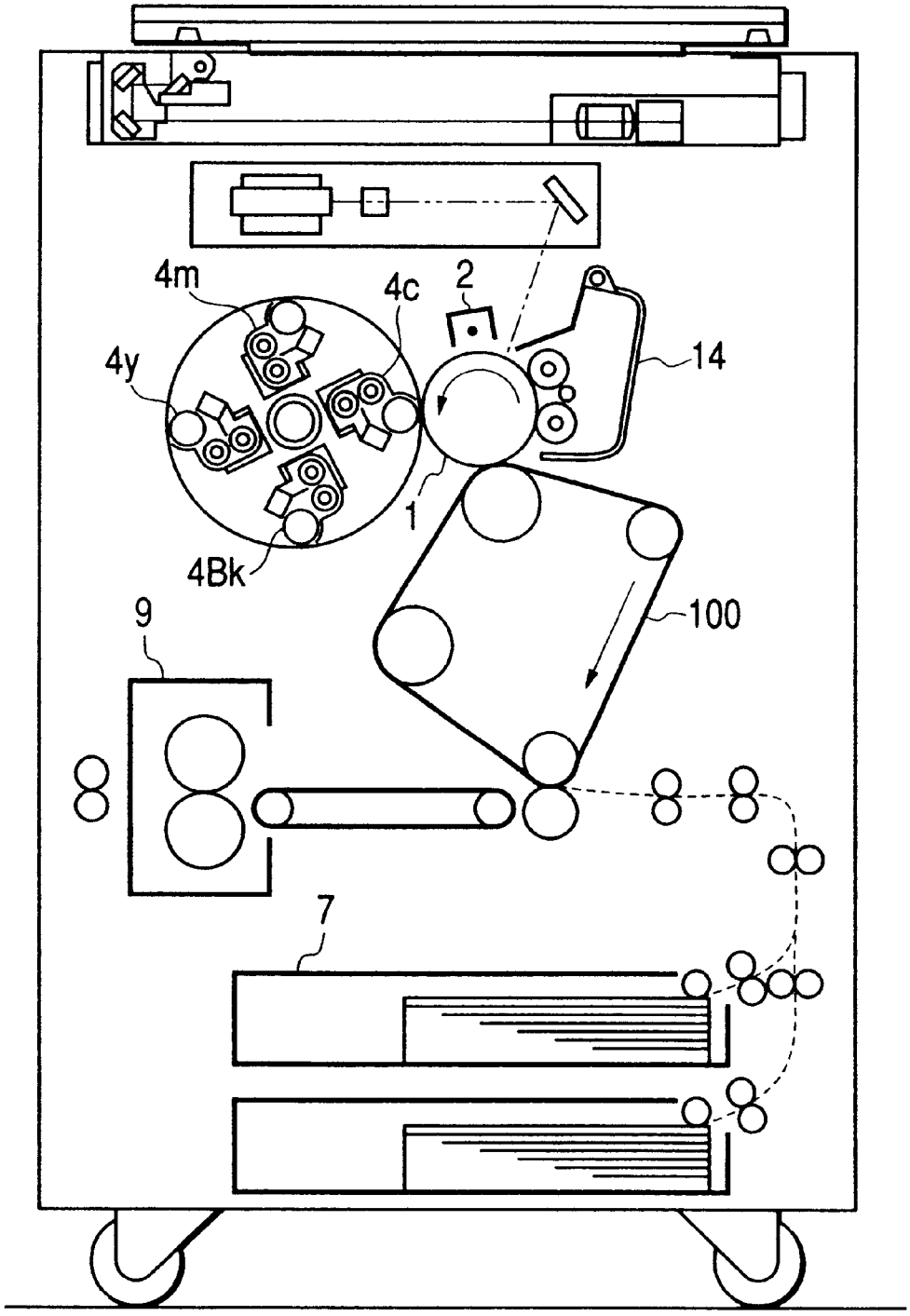
FIG. 7 is a diagram showing still another applied example of the present invention.
Figure 8:
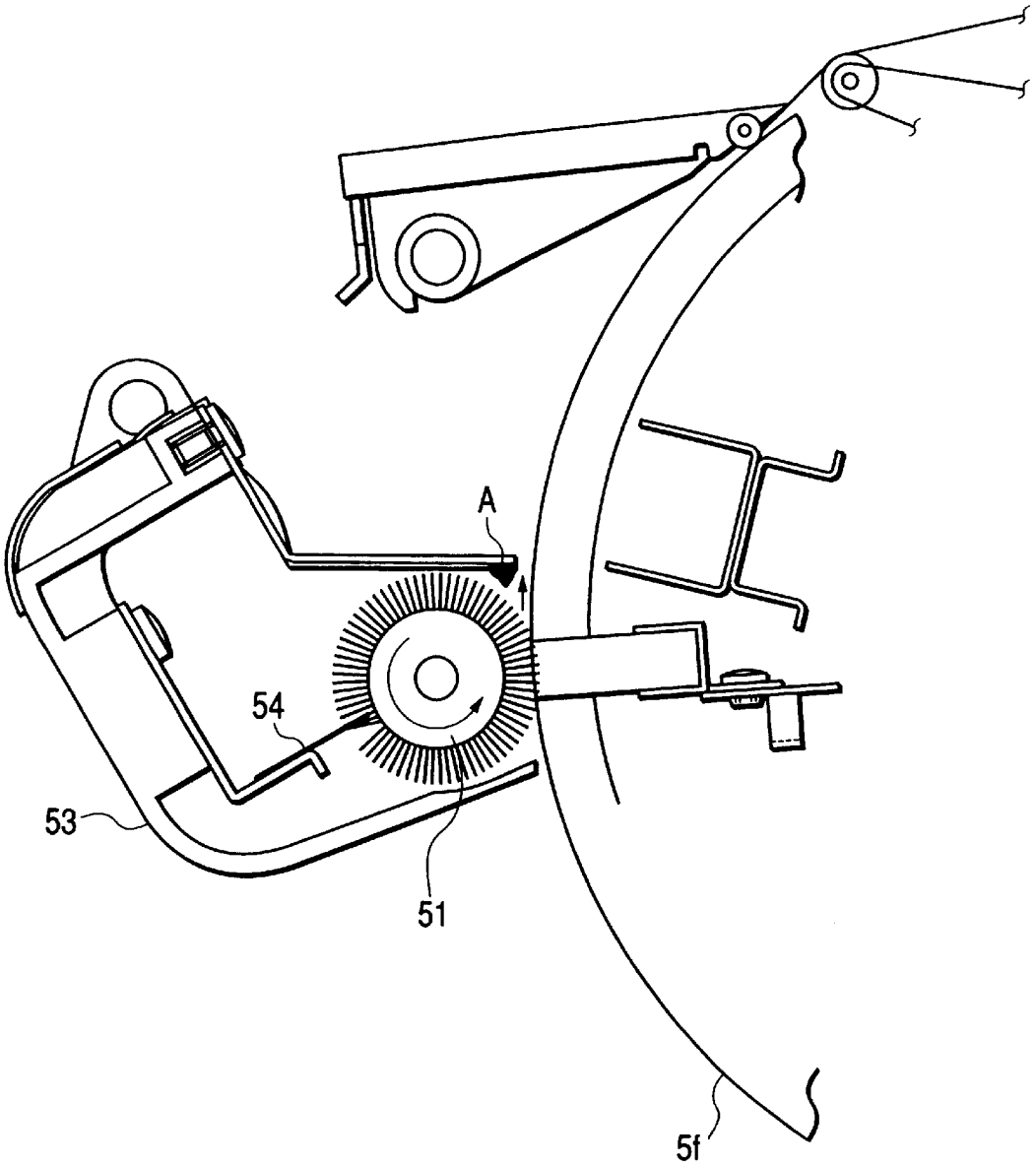
FIG. 8 is a cross-sectional view showing a conventional fur brush cleaner.
Figure 9:
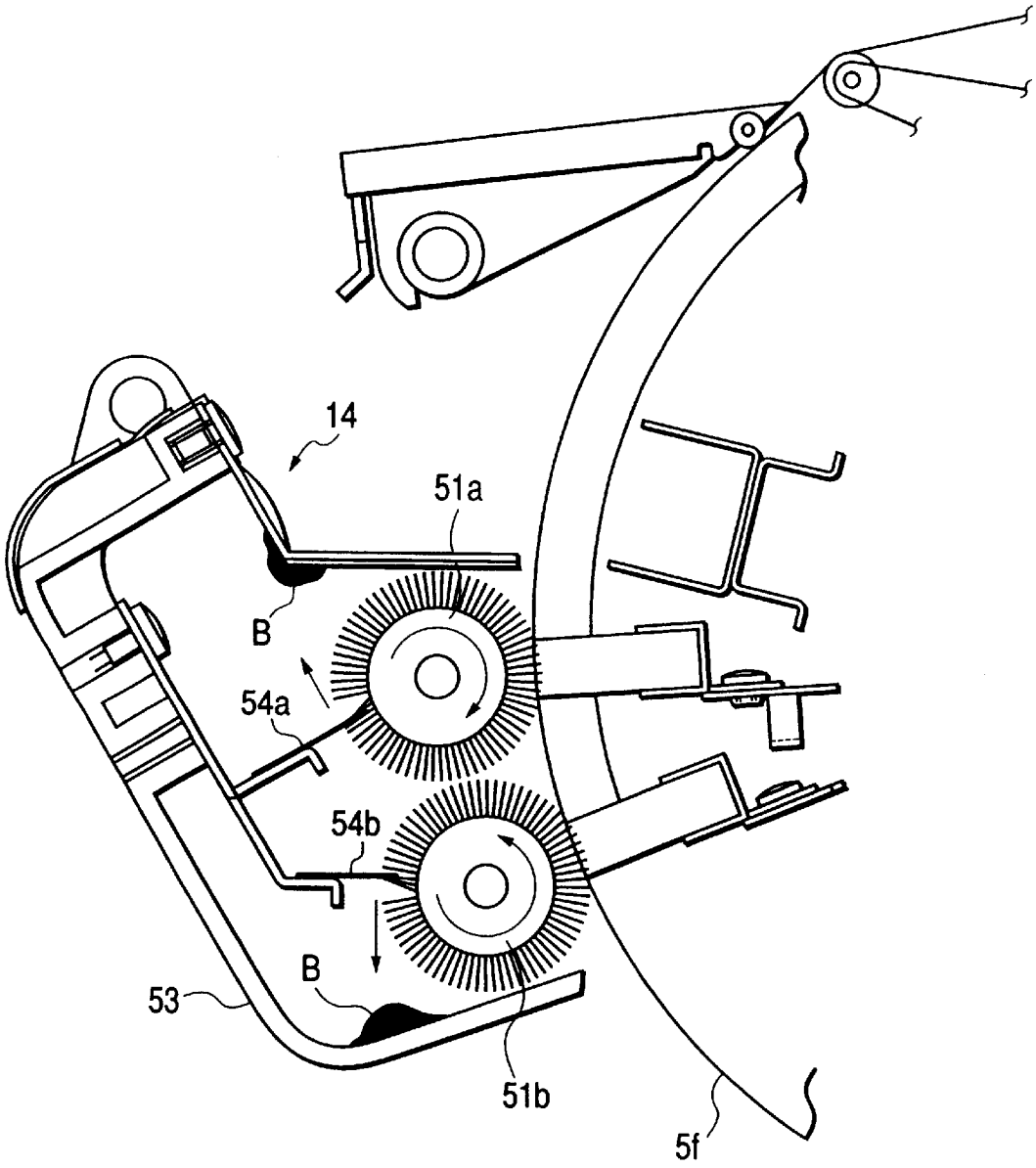
FIG. 9 is a cross-sectional view showing another conventional fur brush cleaner.

Also, as shown in FIG. 7, the present invention can be applied to a cleaning apparatus that cleans the photosensitive member serving as the image bearing member. The image forming process is identical with the image forming process of the image forming apparatus shown in FIG. 7, and a difference resides in that the photosensitive member is cleaned by the cleaner 14.

As described above, since the toner remaining on the photosensitive member is cleaned by using the cleaner 14 described in the above-described first to third embodiments, the same effects as those in the above-mentioned first to third embodiments can be obtained.

The cleaner 14 may be made into a unit together with the photosensitive member, and the unit may be detachably attachable to the image forming apparatus main body. With the above-described structure, the maintenance and the usability can be improved.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A cleaning apparatus that cleans an image bearing member on which a toner image is formed, comprising:

first and second brushes, which are rotatable, remove toner by abutment against the image bearing member, wherein a rotating direction of said first brush in an abutment portion of said first brush against the image bearing member is toward of a position of said second brush, and a rotating direction of said second brush in an abutment portion of said second brush against the image bearing member is toward said first brush;

containing means for containing the toner removed by said first brush and said second brush; and a rubbing member that rubs said first brush and said second brush.

2. A cleaning apparatus according to claim 1, wherein said rubbing member is disposed in a vicinity of a straight line connecting a center of a rotation axis of said first brush and a center of a rotation axis of said second brush.

3. A cleaning apparatus according to claim 2, wherein said rubbing member is disposed at a side apart from said image bearing member with respect to the straight line.

4. A cleaning apparatus according to claim 2, wherein an angle defined by the straight line and a straight line connecting a position in which said first brush and said rubbing member are in contact with each other and the center of a rotation axis of said first brush is 30° or less.

5. A cleaning apparatus according to claim 4, wherein an angle defined by the straight line and a straight line connecting a position in which said second brush and said rubbing member are in contact with each other and the center of a rotation axis of said second brush is 30° or less.

6. A cleaning apparatus according to claim 1, wherein said cleaning apparatus is movable into contact with and separable from the image bearing member.

7. A cleaning apparatus according to claim 1, wherein said first brush is spaced from said second brush by a predetermined space.

8. A cleaning apparatus according to claim 1, wherein said rubbing member splashes the toner removed by said first brush and said second brush toward a side counter to a side on which the image bearing member is disposed.

9. A cleaning apparatus according to claim 1, wherein the image bearing member is a photosensitive member.

10. A cleaning apparatus according to claim 9, wherein said cleaning apparatus is detachably attachable to an image forming apparatus.

11. A cleaning apparatus that cleans a recording material bearing member that bears and conveys a recording material for transferring a toner image on an image bearing member onto the recording material, said cleaning apparatus comprising:

first and second brushes, which are rotatable, remove toner by abutment against said recording material bearing member, wherein a rotating direction of said first brush in an abutment portion of said first brush against the recording material bearing member is toward said second brush, and a rotating direction of said second brush in an abutment portion of said second brush against the recording material bearing member is toward said first brush;

containing means for containing the toner removed by said first brush and said second brush; and a rubbing member that rubs said first brush and said second brush.

12. A cleaning apparatus according to claim 11, wherein said rubbing member is disposed in a vicinity of a straight line connecting between a center of a rotation axis of said first brush and a center of a rotation axis of said second brush.

13. A cleaning apparatus according to claim 12, wherein said rubbing member is disposed at a side apart from said recording material bearing member with respect to the straight line.

14. A cleaning apparatus according to claim 12, wherein an angle defined by the straight line and a straight line connecting a position in which said first brush and said rubbing member are in contact with each other and the center of a rotation axis of said first brush is 30° or less.

15. A cleaning apparatus according to claim 14, wherein an angle defined by the straight line and a straight line connecting a position in which said second brush and said rubbing member are in contact with each other and the center of a rotation axis of said second brush is 30° or less.

16. A cleaning apparatus according to claim 11, wherein said cleaning apparatus is movable into contact with and separable from the recording material bearing member.

17. A cleaning apparatus according to claim 11, wherein said first brush is spaced from said second brush by a predetermined space.

18. A cleaning apparatus according to claim 11, wherein said rubbing member splashes the toner removed by said first brush and said second brush toward a side counter to a side on which said recording material bearing member is disposed.

19. A cleaning apparatus according to claim 11, wherein said cleaning apparatus is detachably attachable to an image forming apparatus.

20. An image forming apparatus, comprising:

an image bearing member for bearing a toner image, wherein the toner image on said image bearing member is transferred onto a transfer medium;

first and second brushes, which are rotatable and remove toner by abutment against said image bearing member, wherein a rotating direction of said first brush in an abutment portion of said first brush against said image bearing member is toward said second brush, and a rotating direction of said second brush in an abutment portion of said second brush against said image bearing member is toward said first brush;

containing means for containing the toner removed by said first brush and said second brush; and a rubbing member that rubs said first brush and said second brush.

21. An image forming apparatus according to claim 20, wherein said rubbing member is disposed in a vicinity of a straight line connecting between a center of a rotation axis of said first brush and a center of a rotation axis of said second brush.

22. An image forming apparatus according to claim 21, wherein said rubbing member is disposed at a side apart from said image bearing member with respect to the straight line.

23. An image forming apparatus according to claim 21, wherein an angle defined by the straight line and a straight line connecting a position in which said first brush and said rubbing member are in contact with each other and the center of a rotation axis of said first brush is 30° or less.

24. An image forming apparatus according to claim 23, wherein an angle defined by the straight line and a straight line connecting a position in which said second brush and said rubbing member are in contact with each other and the center of a rotation axis of said second brush is 30° or less.

25. An image forming apparatus according to claim 20, wherein said first brush and said second brush are movable into contact with and separable from said image bearing member.

26. An image forming apparatus according to claim 20, further comprising a unit including said first brush, said second brush, said rubbing member and said containing means, wherein said unit is detachably attachable to a main body of said image forming apparatus.

27. An image forming apparatus according to claim 20, wherein said first brush is spaced from said second brush by a predetermined space.

28. An image forming apparatus according to claim 20, wherein the toner image on said transfer medium, which is transferred from said image bearing member is transferred onto a recording member.

29. An image forming apparatus according to claim 20, wherein toner images of a plurality of colors are sequentially superimposed and transferred on said transfer medium.

30. An image forming apparatus, comprising:

an image bearing member for bearing a toner image;

a recording material bearing member that bears a recording material, wherein the toner image on said image bearing member is transferred onto the recording material borne by said recording material bearing member;

first and second brushes, which are rotatable, remove toner by abutment against the recording material bearing member, wherein a rotating direction of said first brush in an abutment portion of said first brush against said recording material bearing member is toward said second brush, and a rotating direction of said second brush in an abutment portion of said second brush against said recording material bearing member is toward said first brush;

containing means for containing the toner removed by said first brush and said second brush; and a rubbing member that rubs both of said first brush and said second brush.

31. An image forming apparatus according to claim 30, wherein said rubbing member is disposed in a vicinity of a straight line connecting a center of a rotation axis of said first brush and a center of a rotation axis of said second brush.

32. An image forming apparatus according to claim 31, wherein said rubbing member is disposed at a side apart from said recording material bearing member with respect to the straight line.

33. An image forming apparatus according to claim 31, wherein an angle defined by the straight line and a straight line connecting a position in which said first brush and said rubbing member are in contact with each other and the center of a rotation axis of said first brush is 30° or less.

34. An image forming apparatus according to claim 33, wherein an angle defined by the straight line and a straight line connecting a position in which said second brush and said rubbing member are in contact with each other and the center of a rotation axis of said second brush is 30° or less.

35. An image forming apparatus according to claim 30, wherein said first brush and said second brush are movable into contact with and separable from said recording material bearing member.

36. An image forming apparatus according to claim 30, further comprising a unit including said first brush, said second brush, said rubbing member, and said containing means, wherein said unit is detachably attachable to a main body of an image forming apparatus.

37. An image forming apparatus according to claim 30, wherein said first brush is spaced from said second brush by a predetermined space.

38. An image forming apparatus according to claim 30, wherein toner images of a plurality of colors are sequentially superimposed and transferred onto the recording material borne by said recording material bearing member.

* * * * *

UNITED STATES PATENT AND TRADEMARK OFFICE

CERTIFICATE OF CORRECTION

PATENT NO. : 6,493,535 B2
DATED : December 10, 2002
INVENTOR(S) : Hisakazu Okubo It is certified that error appears in the above-identified patent and that said Letters Patent is hereby corrected as shown below:

Column 3,
Line 60, “dielectric” should read -- a dielectric material --.

Column 5,
Line 62, “inmost” should read -- innermost --.

Column 6,
Line 10, “inmost” should read -- innermost --; and “pot” should read -- port --; and
Line 64, “external” should read -- exterior --.

Column 7,
Line 47, “toward of a position of said second brush” should read -- toward said second brush --.

Signed and Sealed this

Eighth Day of July, 2003

JAMES E. ROGAN
*Director of the United States Patent and Trademark Office*